US007689161B2

(12) United States Patent
Onomatsu et al.

(10) Patent No.: US 7,689,161 B2
(45) Date of Patent: Mar. 30, 2010

(54) BROADCAST RECEIVER WITH SELECTIVE SCANNING AND SIGNAL RETRIEVAL

(75) Inventors: Takehiro Onomatsu, Osaka (JP); Shusuke Narita, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 829 days.

(21) Appl. No.: 11/166,049

(22) Filed: Jun. 24, 2005

(65) Prior Publication Data

US 2006/0003691 A1 Jan. 5, 2006

(30) Foreign Application Priority Data

Jun. 25, 2004 (JP) ..... P2004-188645

(51) Int. Cl.
*H04H 20/71* (2008.01)

(52) U.S. Cl. ..... 455/3.01; 455/3.05; 455/3.06; 455/63.4; 455/193.1; 455/185.1; 342/74; 342/76; 725/63; 725/68

(58) Field of Classification Search ..... 455/3.01–3.06, 455/63.4, 179.1, 181.1, 184.1, 185.1, 193.1; 725/63, 68, 72, 151; 342/74–76, 148, 154, 342/157, 158, 354, 359, 367, 368, 371, 373, 342/374, 357.09, 357.15
See application file for complete search history.

(56) References Cited

U.S. PATENT DOCUMENTS 5,515,058 A * 5/1996 Chaney et al. ..... 342/359

FOREIGN PATENT DOCUMENTS

JP 54-16155 2/1979

(Continued)

OTHER PUBLICATIONS

Translation of Japanese Pub. 11-298226.*

(Continued)

*Primary Examiner*—Edward Urban
*Assistant Examiner*—Fayyaz Alam
(74) *Attorney, Agent, or Firm*—Osha • Liang LLP

(57) ABSTRACT

A broadcast receiver for receiving airwaves by a directional switching antenna capable of switching directivity in a plurality of directions, includes a control unit for performing signal return processing for making a return to a normal reception state when it becomes impossible to receive the airwaves by the antenna. The signal return processing includes a plurality of signal return processings of different kinds. When impossibility of reception occurs, the control unit selects optimum signal return processing from among the plurality of signal return processings according to predetermined conditions and executes the selected signal return processing.

7 Claims, 12 Drawing Sheets

U.S. PATENT DOCUMENTS

| | | | | |
|---|---|---|---|---|
| 5,983,071 | A * | 11/1999 | Gagnon et al. | 725/72 |
| 6,229,480 | B1 * | 5/2001 | Shintani | 342/359 |
| 6,661,373 | B1 * | 12/2003 | Holliday | 342/359 |
| 6,697,610 | B1 * | 2/2004 | Tait | 455/277.1 |
| 2002/0083458 | A1 * | 6/2002 | Henderson et al. | 725/72 |
| 2004/0128689 | A1 * | 7/2004 | Pugel et al. | 725/72 |
| 2004/0248517 | A1 * | 12/2004 | Reichgott et al. | 455/63.4 |
| 2007/0044125 | A1 * | 2/2007 | Lee | 725/72 |

FOREIGN PATENT DOCUMENTS

| | | |
|---|---|---|
| JP | 61-288630 | 12/1986 |
| JP | 62-69733 | 3/1987 |
| JP | 2000-332666 | 11/2000 |
| JP | 2001-168627 | 6/2001 |
| JP | 2003-347821 | 12/2003 |

OTHER PUBLICATIONS

Translation of Japanese Pub. 62-069733.*

Patent Abstracts of Japan, Publication No. 54-016155, Publication Date Feb. 6, 1979, 1 page.

Patent Abstract of Japan, Publication No. 2001-168627, Publication Date Jun. 22, 2001, 1 page.

Japanese Office Action for Japanese Patent Application No. 2004-188645, mailed Apr. 21, 2009, and English translation thereof, 5 pages.

* cited by examiner

FIG. 11

| CHANNEL | NEAR DIRECTION | DISTANT DIRECTION | SAME DIRECTION |
|---|---|---|---|
| 2CH | 18 | 3 | 6 |
| 4CH | 11 | 2 | 9 |
| 6CH | 5 | 12 | 3 |
| 8CH | 9 | 1 | 10 |
| 10CH | 8 | 5 | 8 |
| ⋮ | ⋮ | ⋮ | ⋮ |

FIG. 12

| CHANNEL | RECEPTION SENSITIVITY |
|---|---|
| 2CH | 60% |
| 4CH | 75% |
| 6CH | 95% |
| 8CH | 80% |
| 10CH | 65% |
| ⋮ | ⋮ |

BROADCAST RECEIVER WITH SELECTIVE SCANNING AND SIGNAL RETRIEVAL

BACKGROUND OF THE INVENTION

1. Field of the Invention

The present invention relates to a broadcast receiver for receiving airwaves of a predetermined channel sent from plural broadcast stations by a directional switching antenna.

2. Description of the Related Art

In Japan, airwaves of television broadcasts etc. are generally sent from a base station of one place. As a result of that, almost all the airwaves sent by plural broadcast stations can be received by directing an antenna for broadcast receiving to the base station and fixing the antenna to a roof or a veranda, etc. of a house and connecting the antenna to a broadcast receiver through a cable. On the other hand, for example, in the U.S.A., airwaves are individually sent from plural broadcast stations, respectively. As a result of that, when an antenna is directed at one place and is fixed, airwaves of the broadcast station located in a direction in which the antenna is directed can be received, but airwaves of the broadcast station located in a direction in which the antenna is not directed cannot be received.

Therefore, it is necessary to switch directivity of an antenna in plural directions in order to receive radio waves from plural broadcast stations located in different bearings by one antenna. An antenna capable of switching such directivity (hereinafter called "a directional switching antenna") is described in, for example, JP-A-2001-168627 (Paragraph 0015, FIG. 1) and JP-A-54-16155 (Page 2, Line 1 of the upper left field to Page 3, Line 12 of the upper right field, FIGS. 1 to 5) mentioned below. The directional switching antenna is constructed of plural antenna elements and phase shifters, etc. corresponding to each of the antenna elements, and directivity is electrically varied by adjusting phases of signals received in each of the antenna elements by each of the phase shifters and combining the phases. For example, in a smart antenna which is one example of the directional switching antenna, it is stipulated that directivity should be switched in 16 directions.

In the case of using such a directional switching antenna, airwaves from each of the broadcast stations can be received by sending a control signal from a broadcast receiver to the antenna and switching directivity of the antenna in a predetermined direction. As a result of this, a user can receive almost all the airwaves sent from plural broadcast stations interspersed even when the directional switching antenna is fixed and attached to a roof etc. of a house.

In the broadcast receiver for receiving airwaves by the directional switching antenna as described above, when a lock state of a frequency deviates, a reception impossibility state in which the airwaves received until then cannot be received normally occurs. In such a case, signal return processing for returning the state to a normal reception state is required. As a method of the signal return processing, for example, it is contemplated to sequentially scan all the bearings of the antenna and retrieve a receivable direction. However, in this method, possibility or impossibility of reception for all the directions is searched, so that accuracy of retrieval is high, but it often takes time to perform the signal return and in all the cases, the method is not necessarily an optimum method.

Therefore, an object of the invention is to provide a broadcast receiver capable of efficiently detecting a receivable direction and reducing time necessary for a signal is return when impossibility of reception occurs in a directional switching antenna.

SUMMARY OF THE INVENTION

In the invention, in a broadcast receiver for receiving airwaves by a directional switching antenna capable of switching directivity in plural directions, there is provided control unit for performing signal return processing for making a return to a normal reception state when it becomes impossible to receive the airwaves by the antenna, and the signal return processing executed by this control unit includes plural signal return processing of different kinds. Then, when impossibility of reception occurs, the control unit selects optimum signal return processing from among the plural signal return processing according to predetermined conditions and executes the selected signal return processing.

Thus, at the time of occurrence of impossibility of reception, optimum signal return processing is selected from among the plural signal return processing and is executed and thereby, the optimum signal return processing according to a situation can be performed and time necessary for a signal return can be reduced. Incidentally, "impossibility of reception" in the invention refers to not only the case that a received signal cannot be detected at all but also the case that a level of a received signal is less than a certain value even when the received signal can be detected.

Also, in the invention, there is provided a storage unit for storing information about the past oriented direction decision every channel. In this case, the control unit reads the past oriented direction decision information corresponding to a channel at the time when impossibility of reception occurs out of the storage unit, and selects optimum signal return processing from among plural signal return processing based on the information. For example, the optimum signal return processing is selected based on a distant and near relation between an oriented direction at the time of occurrence of impossibility of reception and an oriented direction decided that reception can be performed at the time of channel selection or signal return processing obtained from the oriented direction decision information. As a result of this, the return processing with high accuracy in consideration of a tendency of the previous oriented direction decision can be performed.

Also, in the invention, there may be provided a storage unit for storing reception sensitivity of airwaves every channel. In this case, the control unit reads the reception sensitivity corresponding to a channel at the time when impossibility of reception occurs out of the storage unit, and selects optimum signal return processing from among plural signal return processing based on the reception sensitivity. As a result of this, the return processing with high accuracy according to the reception sensitivity can be performed.

Also, in the invention, when impossibility of reception occurs, it may be constructed so as to select optimum signal return processing from among plural signal return processing based on a time zone at that time. As a result of this, even when a broadcast state varies every time zone, the return processing with high accuracy according to the time zone can be performed.

As the signal return processing of the invention, for example, the return processing of three kinds can be used. First signal return processing is processing for retrieving a receivable direction by shifting an oriented direction by a predetermined amount counterclockwise or clockwise from a reference direction using an oriented direction at the time of impossibility of reception as the reference direction and alternately repeating counterclockwise shifts and clockwise shifts while increasing the shift amount. Second signal return processing is processing for retrieving a receivable direction while sequentially shifting an oriented direction over all the bearings of the antenna. Third signal return processing is processing for waiting until a certain time has elapsed since a point in time of occurrence of impossibility of reception and starting retrieval of a receivable direction when a return to a normal reception state is not made within the certain time.

When the signal return processing of three kinds as described above is prepared, it could be constructed so that the first signal return processing is executed in the case of determining that there are many cases where an oriented direction decided for a channel at the time of the occurrence of impossibility of reception based on the past oriented direction decision information is a direction near an oriented direction at the time of the occurrence of impossibility of reception and the second signal return processing is executed in the case of determining that there are many cases where the oriented direction is a direction distant from an oriented direction at the time of the occurrence of impossibility of reception and the third signal return processing is executed in the case of determining that there are many cases where the oriented direction is the same direction as an oriented direction at the time of the occurrence of impossibility of reception. As a result of this, the optimum signal return processing according to a tendency of the oriented direction decision can be performed.

According to the invention, when impossibility of reception occurs in a directional switching antenna, a receivable direction can be detected efficiently, so that a return to a normal reception state can be made speedily.

BRIEF DESCRIPTION OF THE DRAWINGS

FIG. 11 is a table showing one example of oriented direction decision information; and FIG. 12 is a diagram showing a reception sensitivity table.

DETAILED DESCRIPTION OF THE INVENTION

Figure 1:
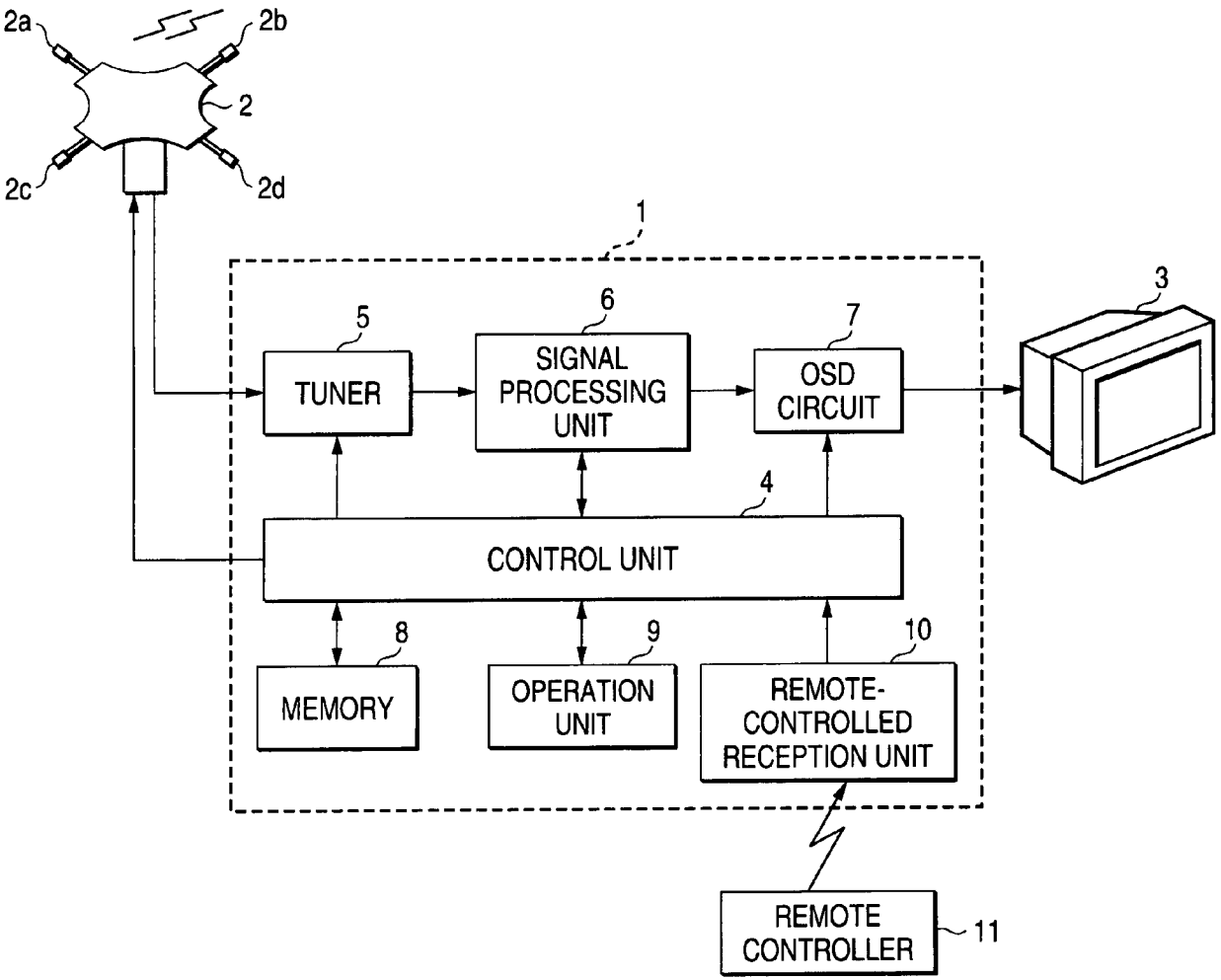
FIG. 1 is a diagram showing a receiving system using a broadcast receiver according to the invention.

FIG. 1 is a diagram showing a receiving system of a television broadcast using a broadcast receiver according to the invention. In FIG. 1, numeral 1 is a broadcast receiver, and numeral 2 is a smart antenna, and numeral 3 is a television image receiving apparatus (hereinafter called "TV set"). The broadcast receiver 1 and the TV set 3 are installed inside a house of a general home and are connected by a cable. The smart antenna 2 is attached and fixed to a roof or a veranda of the house and is connected to the broadcast receiver 1 by a cable.

The smart antenna 2 includes four antenna elements 2*a* to 2*d*, and phase shifters, combination devices and control circuits, etc. (the portions other than the antenna elements 2*a* to 2*d* are omitted in the drawing) disposed corresponding to each of the antenna elements 2*a* to 2*d*, and directivity is electrically switched in 16 directions by adjusting phases of signals received by each of the antenna elements 2*a* to 2*d* through each of the phase shifters and combining the signals after the adjustment through the combination devices. Incidentally, the 16 directions mean each of the directions in which the circumference (360°) of the smart antenna 2 is divided into 16 pieces, and each of the directions is shown by numbers of 0 to 15 (for example, see FIG. 2) The broadcast receiver 1 receives television airwaves sent from plural broadcast stations interspersed in the periphery of the house by controlling the smart antenna 2 and switching directivity of the smart antenna 2. The smart antenna 2 constructs one embodiment of a directional switching antenna in the invention.

Numeral 4 is a control unit made of a CPU, ROM or RAM, etc., and controls each part of the broadcast receiver 1. Data and programs for control are stored in the ROM of the control unit 4, and data for control is readably and writably stored in the RAM. When impossibility of reception occurs, this control unit 4 switches directivity of the smart antenna 2 and detects a receivable direction as described below. The control unit 4 constructs one embodiment of control unit in the invention.

Numeral 5 is a tuner, and extracts a signal of a predetermined channel from airwaves received by the smart antenna 2. Numeral 6 is a signal processing unit, and processes the signal extracted by the tuner 5 and generates a reproduction video signal and a reproduction sound signal. Numeral 7 is an OSD (On Screen Display) circuit, and superimposes image data outputted from the control unit 4 on the reproduction video signal outputted from the signal processing unit 6 and performs on-screen display on a screen of a monitor of the TV set 3. The TV set 3 displays video on the monitor based on the reproduction video signal outputted from the signal processing unit 6 and also outputs sound from a speaker based on the reproduction sound signal outputted from the signal processing unit 6 (illustration of a sound system is omitted in FIG. 1).

Numeral 8 is nonvolatile memory, and numeral 9 is an operation unit including various keys such as a channel key or a power source key, and numeral 10 is a remote-controlled reception unit for receiving a signal from a remote controller 11. The remote controller 11 includes various keys such as a channel key, a menu key and a cross key. The memory 8 constructs one embodiment of a storage unit in the invention.

In the configuration described above, when a user turns on a power source of the broadcast receiver 1 after the broadcast receiver 1 is connected to the smart antenna 2, the control unit 4 presets a channel (initialization). Incidentally, when the user operates the remote controller 11 and instructs presetting, the control unit 4 also presets a channel. In the presetting of the channel, channel numbers and numbers of directions capable of reception in the channels are sequentially recorded in the memory 8. Then, when presettings of all the channels are completed, a channel presetting table in which the channel numbers are associated with the direction numbers is created in a predetermined region of the memory 8.

The creation of the channel presetting table means that almost all the airwaves sent from the plural broadcast stations interspersed in the periphery of the house can be received to set receivable directions of the antenna to the broadcast receiver 1 every channel number. As a result of this, when the user operates the remote controller 11 and switches a channel after the creation of the table, the control unit 4 reads a direction capable of receiving airwaves of the channel of a switching destination out of the table and switches directivity of the smart antenna 2 in the direction shown by the number and thereby the airwaves of the same channel number can be received immediately. Then, the received airwaves are processed by the tuner 5 and the signal processing unit 6 and immediately, video can be displayed on the TV set 3 and also sound can be outputted. As a result of this, time necessary for the user to be able to view a broadcast of the channel number of the switching destination can be reduced.

Figure 2:
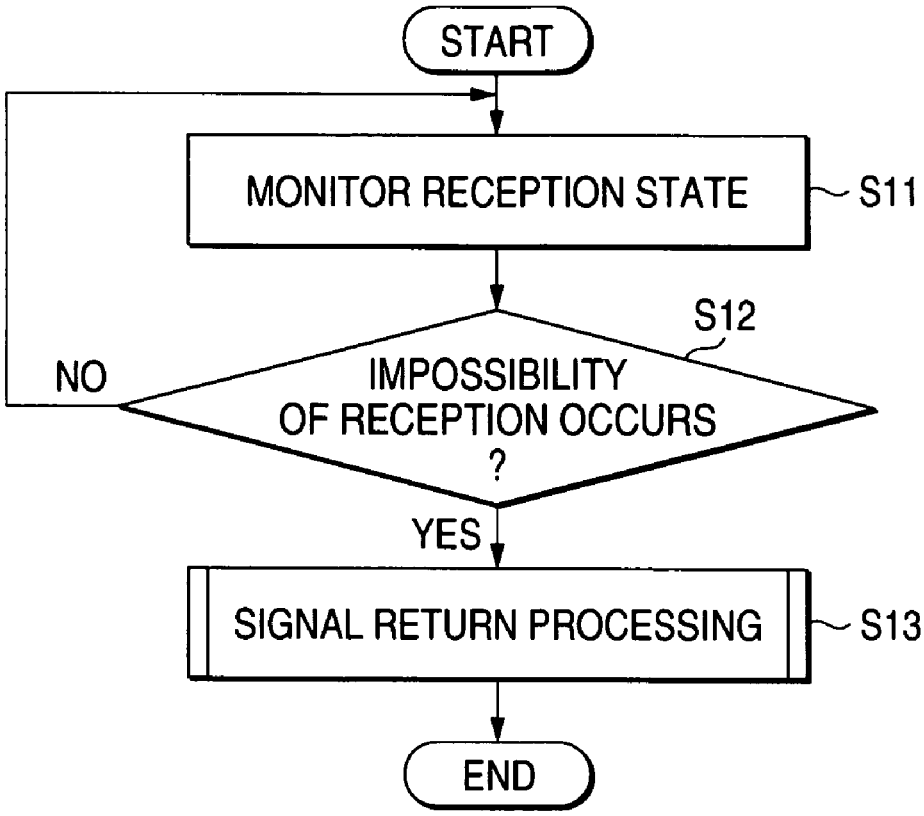
FIG. 2 is a flowchart representing the whole action.
Figure 3:
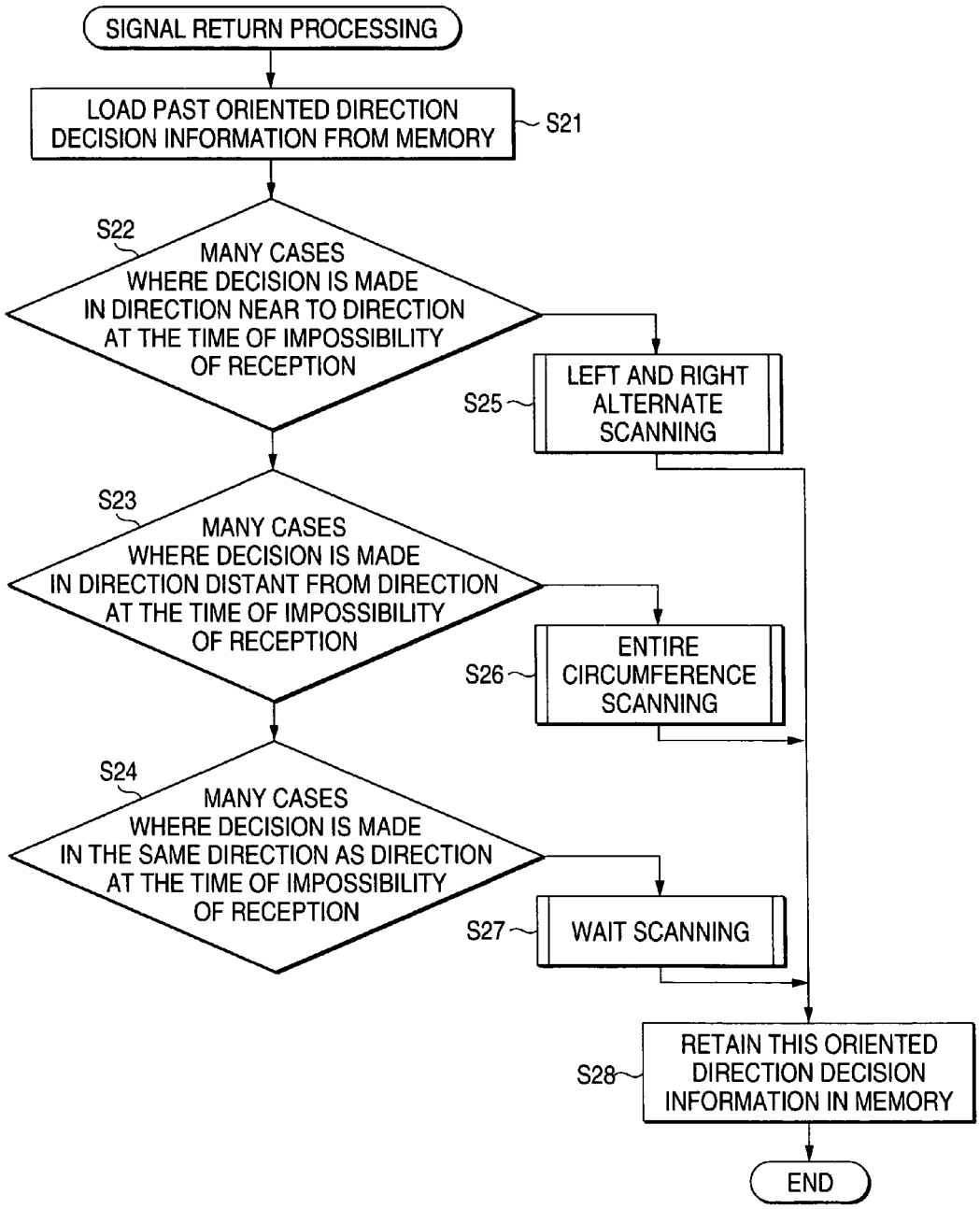
FIG. 3 is a flowchart representing a procedure of signal return processing.

Next, an action of the case that impossibility of reception occurs in the broadcast receiver 1 mentioned above will be described. FIG. 2 is a flowchart showing the whole action. The CPU of the control unit 4 executes this procedure according to a program stored in the ROX. The control unit 4 always monitors a reception state of the smart antenna 2 (step S11). When a level of a received signal in the smart antenna 2 is a threshold value or more, a reception impossibility state does not occur (step S12: NO) and the flowchart returns to step S11 and monitoring of the reception state is continued. When the level of the received signal in the smart antenna 2 becomes less than the threshold value, it is determined that the reception impossibility state occurs (step S12: YES) ; and the flowchart proceeds to execution of signal return processing (step S13) FIG. 3 is a flowchart showing a concrete procedure of the signal return processing in the step S13. The CPU of the control unit 4 executes this procedure according to a program stored in the ROM. When the signal return processing is started, the control unit 4 first reads out the past oriented direction decision information stored in the memory 8 (step S21).

FIG. 11 is a table showing one example of the oriented direction decision information. It is determined that an oriented direction decided that reception can be performed at the time of channel selection or signal return processing has any distant and near relation to an oriented direction at the time of occurrence of impossibility of reception, and it is classified into any of the "near direction", "distant direction" and "same direction". Every channel selection or signal return processing, the determination and classification are made with respect to the received channel at that time and one is added to the corresponding field of the table of FIG. 11. Therefore, numeric characters recorded in this table give an index indicating that a receivable oriented direction tends to be decided in any direction in each of the channels.

The control unit 4 examines a tendency to decide an oriented direction for the received channel at the time of occurrence of impossibility of reception with reference to the table of FIG. 11. For example, when the received channel is Channel 2, there are many cases where a receivable oriented direction is decided in a direction near the oriented direction at the time of occurrence of impossibility of reception (step S22), so that left and right alternate scanning described below is selected as the signal return processing and this scanning is executed (step S25).

Also, when the received channel is Channel 6, there are many cases where a receivable oriented direction is decided in a direction distant from the oriented direction at the time of occurrence of impossibility of reception (step S23), so that entire circumference scanning described below is selected as the signal return processing and this scanning is executed (step S26).

Also, when the received channel is Channel 8, there are many cases where a receivable oriented direction is decided in the same direction as the oriented direction at the time of occurrence of impossibility of reception (step S24), so that wait scanning described below is selected as the signal return processing and this scanning is executed (step S27).

Also, when the received channel is Channel 10, the proportion of the case of being decided in the near direction is equal to the proportion of the case of being decided in the same direction, so that either the left and right alternate scanning (step S25) or the wait scanning (step S27) is selected and this scanning is executed.

Then, when the receivable oriented direction is found by the signal return processing, its direction is decided in a new oriented direction and the smart antenna 2 sets directivity in its direction and receives subsequent airwaves. Also, the control unit 4 determines a distant and near relation between the decided oriented direction and the oriented direction at the time of occurrence of impossibility of reception, and its determination result is retained in the memory 8 as this oriented direction decision information (step S28). As a result of this, the table of FIG. 11 is updated and the signal return processing is ended.

Figure 4:
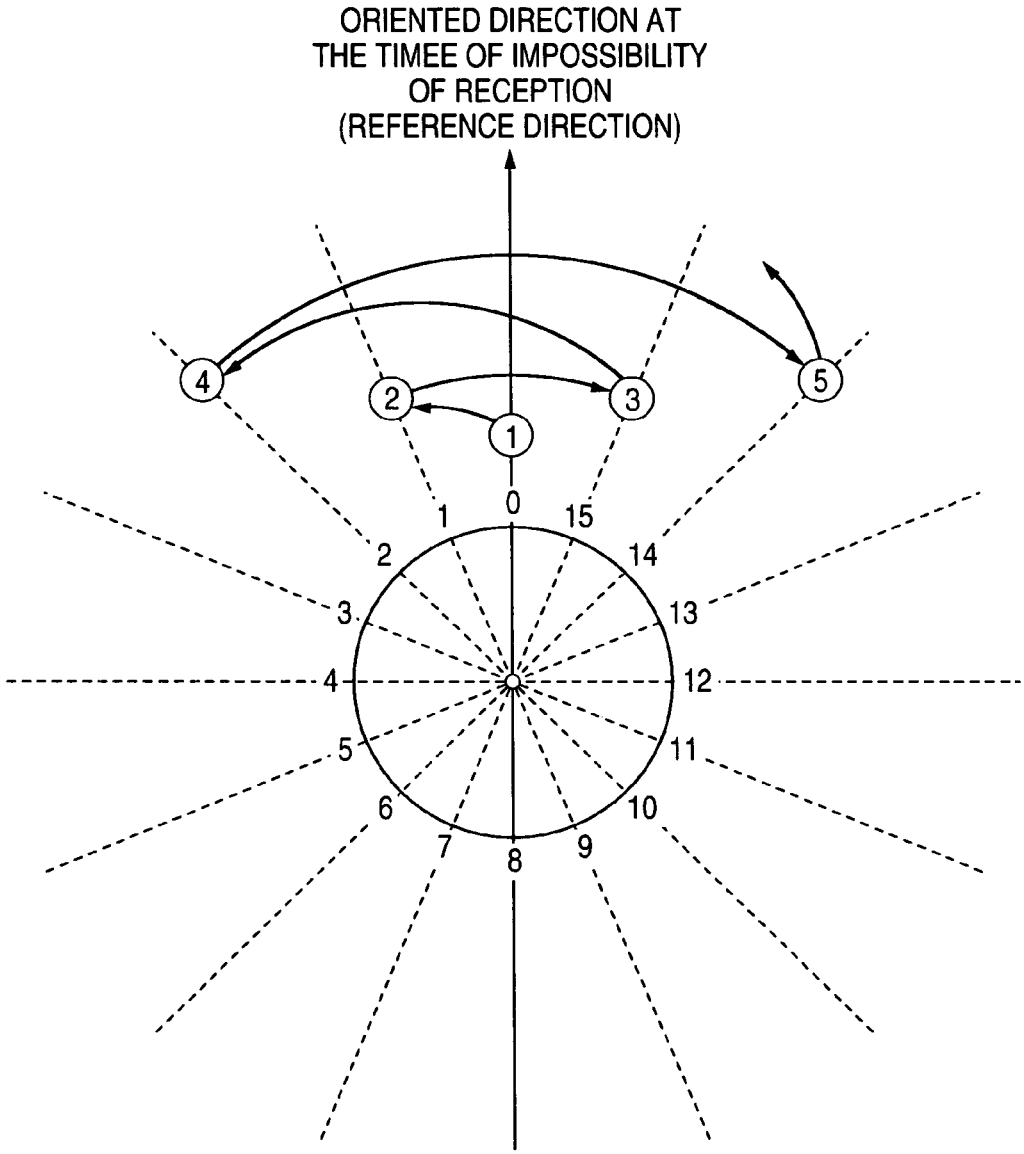
FIG. 4 is a diagram describing left and right alternate scanning.

FIG. 4 is a diagram describing an action of left and right alternate scanning. In FIG. 4, numeric characters of 0 to 15 along the outer circumference of a circle show directions of the antenna. Also, numeric characters in a circle represent the order of shifts of an oriented direction. The numeric characters are similar in FIGS. 6 and 7.

Now, it is assumed that an oriented direction of the antenna at the time when impossibility of reception occurs is a direction 0. Using this direction 0 as a reference direction, the oriented direction is first shifted by one counterclockwise and a level of a received signal in a direction 1 is detected. Then, when the level is a predetermined threshold value or more, it is determined that it is possible to perform reception, and when the level is less than the threshold value, it is determined that it is impossible to perform reception. This determination method is similar in the following description. When it was also impossible to perform reception in the direction 1, the oriented direction is next shifted by one clockwise from the reference direction (direction 0) and a level of a received signal in a direction 15 is detected. When it was also impossible to perform reception in the direction 15, the oriented direction is then shifted by two counterclockwise from the reference direction (direction 0) and a level of a received signal in a direction 2 is detected. When it was also impossible to perform reception in the direction 2, the oriented direction is shifted by two clockwise from the reference direction (direction 0) and a level of a received signal in a direction 14 is detected.

In this manner, while alternately scanning counterclockwise and clockwise, the oriented direction is sequentially shifted and it is determined whether it is possible or impossible to receive airwaves in each of the directions. Then, when a receivable direction is found in its process, the scanning is stopped at that point in time and its direction is decided in a new oriented direction and subsequently, an oriented direction of the antenna is fixed in its direction and the airwaves are received.

As described above, the left and right alternate scanning is a method in which the oriented direction at the time of occurrence of impossibility of reception is used as the reference direction and a retrieval range is gradually extended from this direction to the left and right, so that in the case of having a strong tendency to decide the oriented direction in a direction (for example, directions 1 to 3, 13 to 15 of FIG. 4) near the oriented direction at the time of occurrence of impossibility of reception (step S22 of FIG. 3), the left and right alternate scanning is most suitable for means of the signal return processing and by executing this, a receivable direction can be detected in a short time to make a speedy signal return.

Incidentally, a left and right shift range of the oriented direction is not unlimited and may be limited in a predetermined region near the reference direction. For example, the left side of the reference direction (direction 0) is set in the range of the direction 0 to the direction 2 and the right side of the reference direction (direction 0) is set in the range of the direction 0 to the direction 14 and thereby, the shift range can be limited to the range of 45° to the left and right. Also, when the left side of the reference direction is set in the direction 0 to the direction 3 and the right side of the reference direction is set in the direction 0 to the direction 13, the shift range can be limited to the range of 67.5° to the left and right.

When the receivable direction was not detected in the shift range, returning to the beginning, it is resumed from an action in which the oriented direction is shifted by one counterclockwise using the direction 0 as the reference direction. This action is repeated until the airwaves can be received. The reference direction is a direction in which the airwaves can have been received normally until impossibility of reception occurs, and a direction near its direction has a high probability capable of reception again, so that the receivable direction can be found in a short time by limiting the range and shifting the oriented direction as described above.

Also, in FIG. 4, directivity is shifted by excluding a direction in which it is once determined whether it is possible or impossible to receive the airwaves. That is, in the case of shifting from the direction 1 to the direction 15, the direction 0 in which it has already been determined whether it is possible or impossible to receive them is skipped and in the case of shifting from the direction 15 to the direction 2, the direction 0 and the direction 1 in which it has already been determined whether it is possible or impossible to receive them are skipped and in the case of shifting from the direction 2 to the direction 14, the direction 1, the direction 0 and the direction 15 in which it has already been determined whether it is possible or impossible to receive them are skipped. In this manner, the overlap determination on the same direction is eliminated and search time necessary to detect the receivable direction can be reduced.

Figure 5:
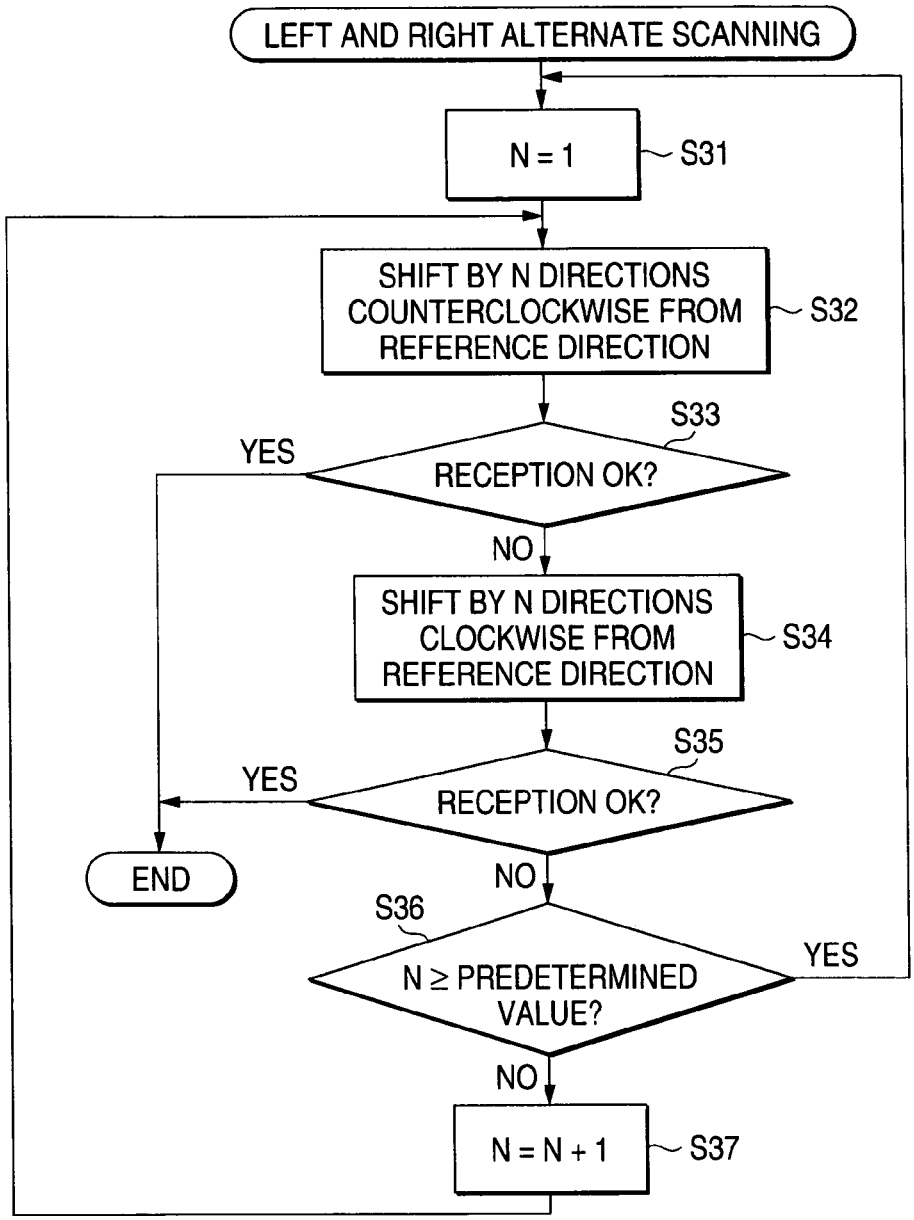
FIG. 5 is a flowchart representing a procedure of the left and right alternate scanning.

FIG. 5 is a flowchart representing a concrete procedure of the left and right alternate scanning in step S25 of FIG. 3. The CPU of the control unit 4 executes this procedure according to a program stored in the ROM.

When processing of the left and right alternate scanning is started, the control unit 4 sets a value of a counter N at N=1 (step S31). This counter is disposed in a predetermined region of, for example, the memory (RAM) of the control unit 4. Then, an oriented direction is shifted by N directions counterclockwise using an oriented direction of the antenna at the time of occurrence of impossibility of reception as a reference direction (step S32). At this point in time, N=1, so that the oriented direction is shifted by one direction counterclockwise. The oriented direction at this time becomes a direction 1 of FIG. 4.

Next, a level of a received signal in the oriented direction (direction 1) after the shift is detected and it is determined whether it is possible or impossible to perform reception (step S33). When it is possible to perform the reception in the direction (step S33: YES), the processing is ended and the flowchart proceeds to step S28 of FIG. 3. On the other hand, when it is impossible to perform the reception (step S33: NO), the oriented direction is shifted by N directions clockwise from the reference direction (direction 0) (step S34). At this point in time, N=1, so that the oriented direction is shifted by one direction clockwise. The oriented direction at this time becomes a direction 15 of FIG. 4.

Then, a level of a received signal in the oriented direction (direction 15) after the shift is detected and it is determined whether it is possible or impossible to perform reception (step S35). When it is possible to perform the reception in the direction (step S35: YES), the processing is ended and the flowchart proceeds to step S28 of FIG. 3. On the other hand, when it is impossible to perform the reception (step S35; NO), it is determined whether or not the value of N reaches a predetermined value (step S36). This predetermined value is a value for limiting a shift range of the oriented direction, in other words, a search range of a receivable direction to a certain range, and is set at, for example, 3. When the predetermined value is set at 3, as can be seen from the description described below, in the shift range of the oriented direction, the left side of the reference direction becomes a region of the direction 0 to a direction 3 and the right side of the reference direction becomes a region of the direction 0 to a direction 13. At this point in time, N=1, so that N<3 is satisfied (step S36: NO) and 1 is added to the value of N to perform N=N+1 (step S37). As a result of this, the value of N becomes 2.

Subsequently, the flowchart returns to step S32 and the oriented direction is shifted by N directions counterclockwise from the reference direction (direction 0). At this point in time, N=2, so that the oriented direction is shifted by two directions counterclockwise. The oriented direction at this time becomes a direction 2 of FIG. 4. Then, a level of a received signal in the oriented direction (direction 2) after the shift is detected and it is determined whether it is possible or impossible to perform reception (step,933). When it is possible to perform the reception in the direction (step S33: YES), the processing is ended and the flowchart proceeds to step S28 of FIG. 3. On the other hand, when it is impossible to perform the reception (step S33: NO), the oriented direction is shifted by N directions clockwise from the reference direction (direction 0) (step S34). At this point in time, N=2, so that the oriented direction is shifted by two directions clockwise. The oriented direction at this time becomes a direction 14 of FIG. 4.

Then, a level of a received signal in the oriented direction (direction 14) after the shift is detected and it is determined whether it is possible or impossible to perform reception (step S35). When it is possible to perform the reception in the direction (step S35: YES), the processing is ended and the flowchart proceeds to step S28 of FIG. 3. On the other hand, when it is impossible to perform the reception (step S35: NO), it is determined whether or not the value of N reaches the predetermined value (step S36). At this point in time, N=2, so that N<3 is satisfied (step S36: NO) and 1 is added to the value of N to perform N=N+1 (step S37). As a result of this, the value of N becomes 3.

Subsequently, the flowchart returns to step S32 and the oriented direction is shifted by N directions counterclockwise from the reference direction (direction 0). At this point in time, N=3, so that the oriented direction is shifted by three directions counterclockwise. The oriented direction at this time becomes a direction 3 of FIG. 4. Then, a level of a received signal in the oriented direction (direction 3) after the shift is detected and it is determined whether it is possible or impossible to perform reception (step S33). When it is possible to perform the reception in the direction (step S33: YES), the processing is ended and the flowchart proceeds to step S28 of FIG. 3. On the other hand, when it is impossible to perform the reception (step S33: NO), the oriented direction is shifted by N directions clockwise from the reference direction (direction 0) (step S34). At this point in time, N=3, so that the oriented direction is shifted by three directions clockwise. The oriented direction at this time becomes a direction 13 of FIG. 4.

Then, a level of a received signal in the oriented direction (direction 13) after the shift is detected and it is determined whether it is possible or impossible to perform reception (step S35). When it is possible to perform the reception in the direction (step S35: YES), the processing is ended and the flowchart proceeds to step S28 of FIG. 3. On the other hand, when it is impossible to perform the reception (step S35: NO), it is determined whether or not the value of N reaches the predetermined value (step S36). At this point in time, N=3, so that N≧3 is satisfied (step S36: YES) and the flowchart proceeds to step S31 and the value of N returns to N=1 and a series of the procedures described above are repeated.

Figure 6:
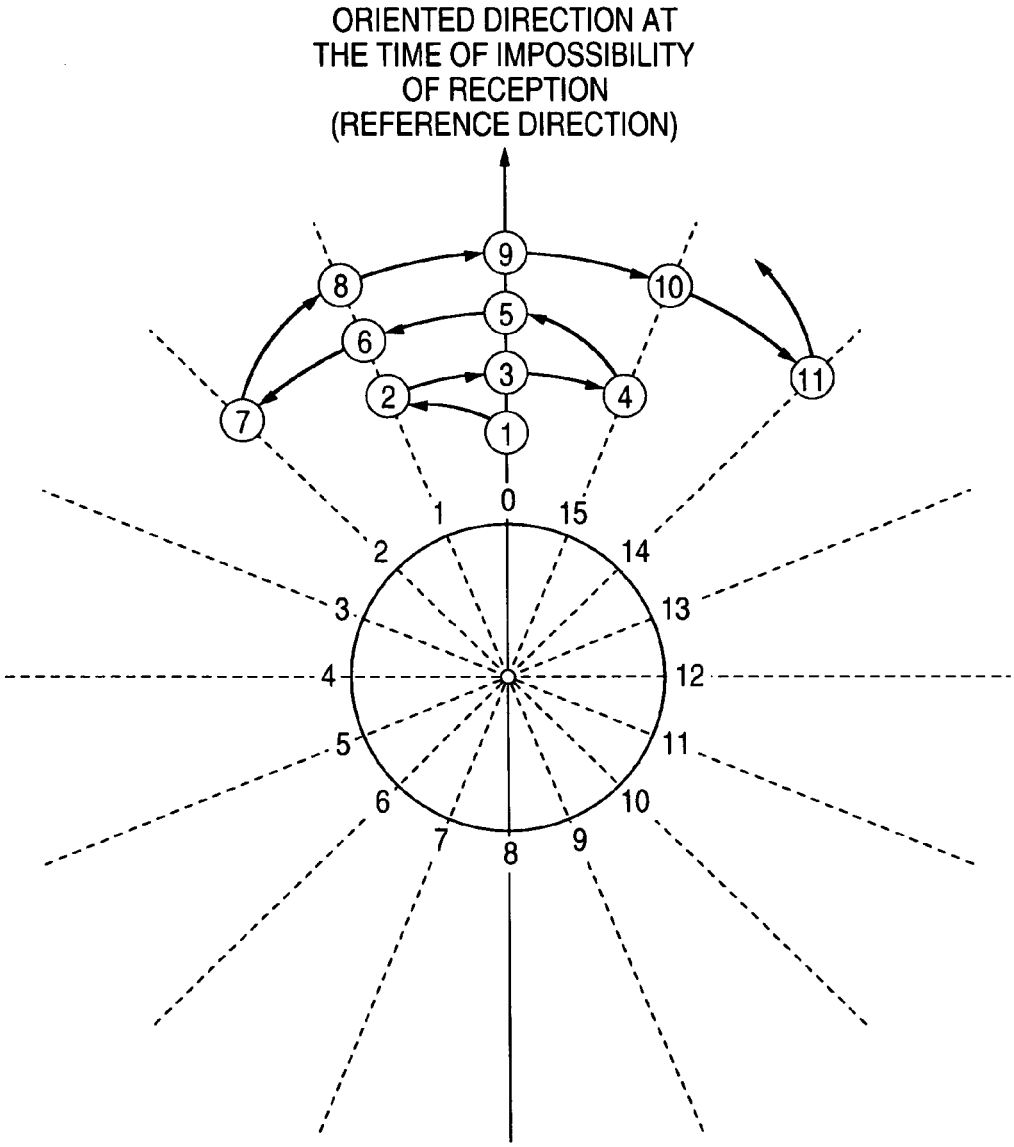
FIG. 6 is a diagram describing another example of left and right alternate scanning.
Figure 7:
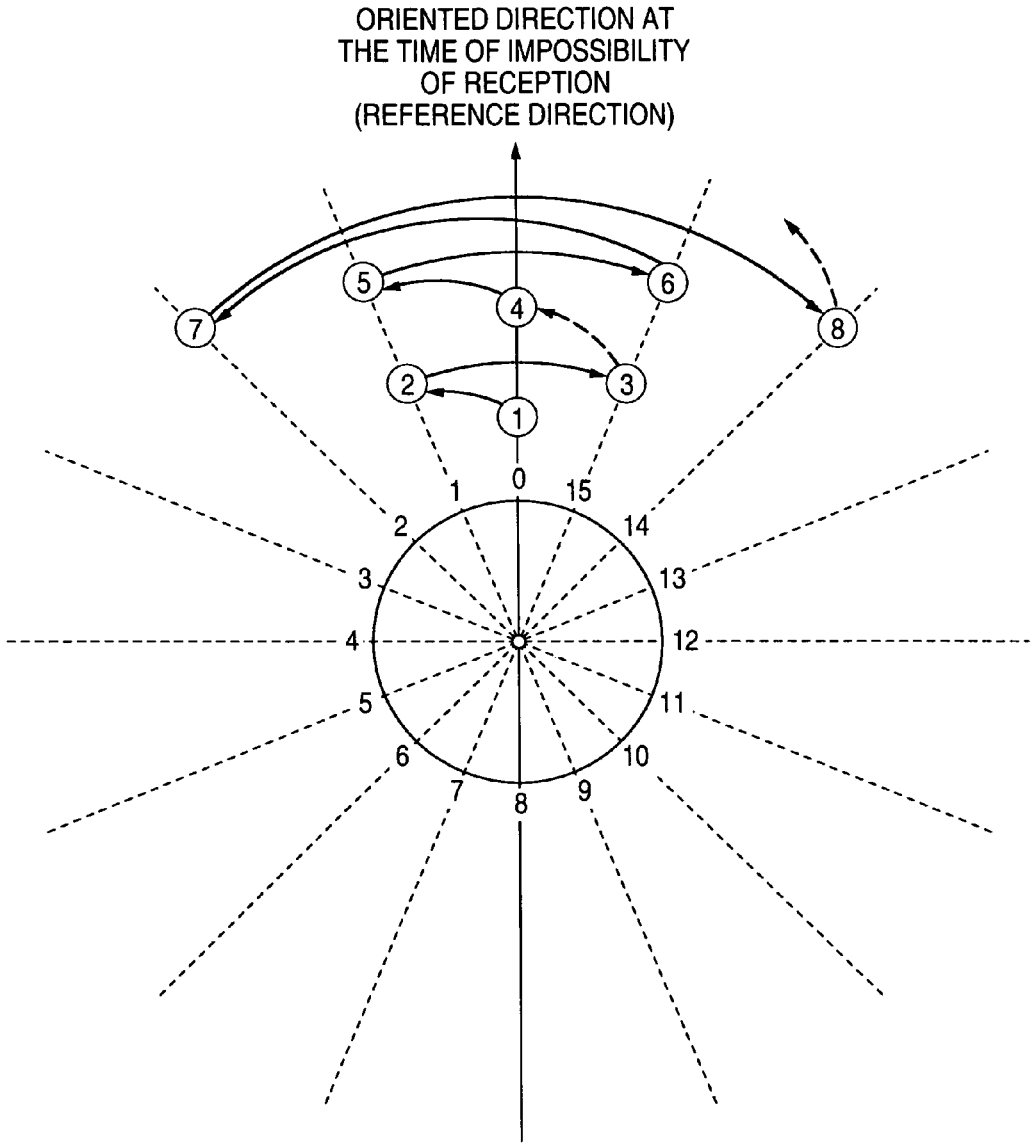
FIG. 7 is a diagram describing another example of left and right alternate scanning.

Incidentally, the left and right alternate scanning is not limited to the method shown in FIG. 4 and other methods may be adopted. For example, as shown in FIG. 6, directivity may be shifted including a direction in which it is once determined whether it is possible or impossible to perform reception. In this case, it takes some time longer than that of the method of FIG. 4, but plural determinations about the same direction are made, so that accuracy of detection of a receivable direction can be improved. Also, as another example, as shown in FIG. 7, it may be constructed so as to extend a shift range in a process in which the method of FIG. 4 is repeated by plural cycles. In this case, search time necessary to detect a receivable direction becomes shorter than that of the method of FIG. 6 and also accuracy of detection of the receivable direction is improved more than that of the method of FIG. 4.

Figure 8:
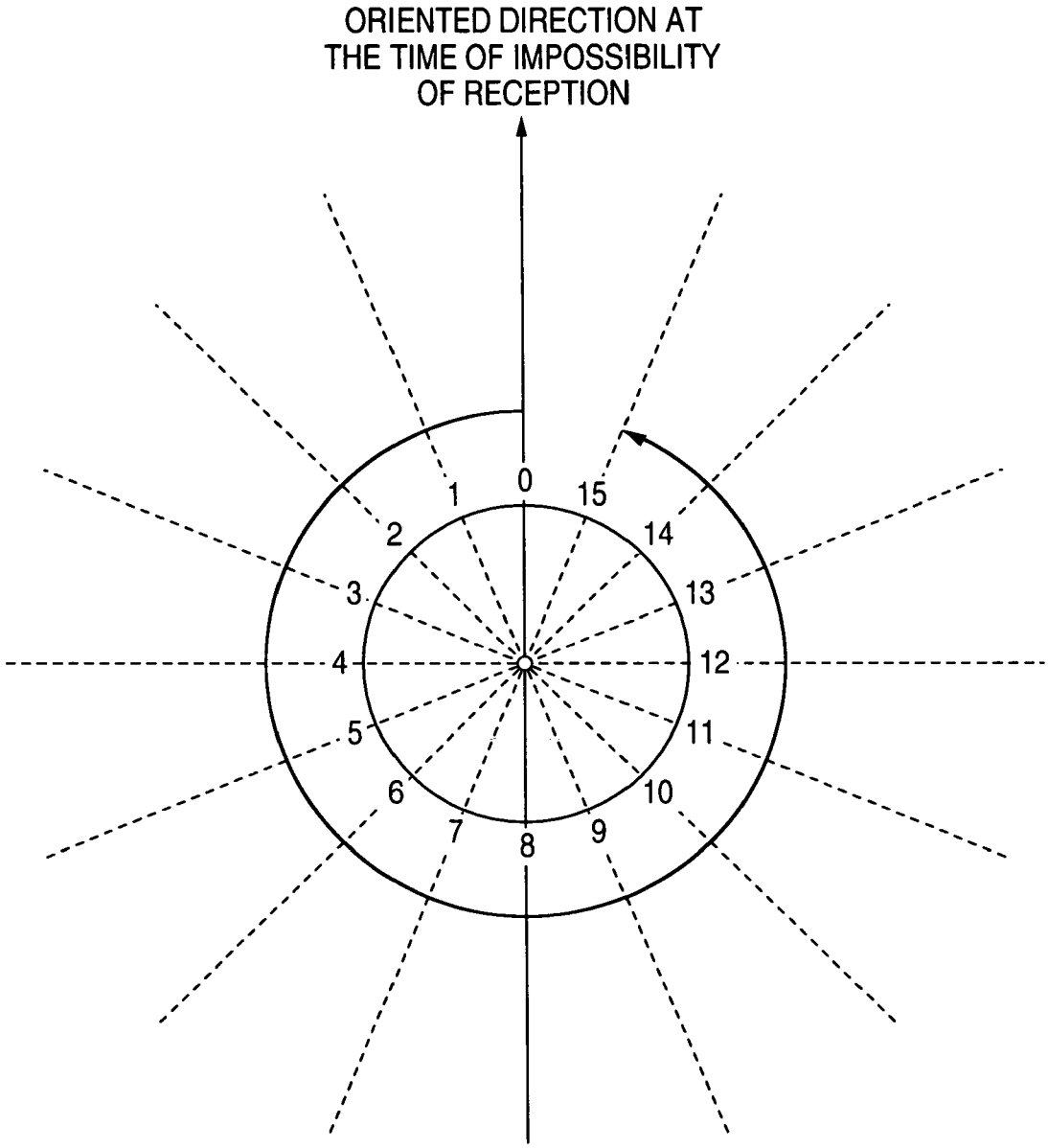
FIG. 8 is a diagram describing entire circumference scanning.

FIG. 8 is a diagram describing an action of entire circumference scanning. In FIG. 8, numeric characters of 0 to 15 along the outer circumference of a circle show directions of the antenna. In the entire circumference scanning, when impossibility of reception occurs, a receivable direction is retrieved by sequentially scanning all the directions (16 directions in this case) of the antenna and detecting levels of received signals in each of the directions.

The entire circumference scanning takes time to perform retrieval, but has an advantage capable of surely finding the receivable direction since searches are sequentially made in all the directions. Therefore, when there is a strong tendency in which an oriented direction is decided in directions (for example, directions 4 to 12 of FIG. 8) distant from the oriented direction at the time of occurrence of impossibility of reception (step S23 of FIG. 3), use of the entire circumference scanning has a higher possibility capable of speedily detecting the receivable direction than use of the left and right alternate scanning as means of the signal return processing.

Figure 9:
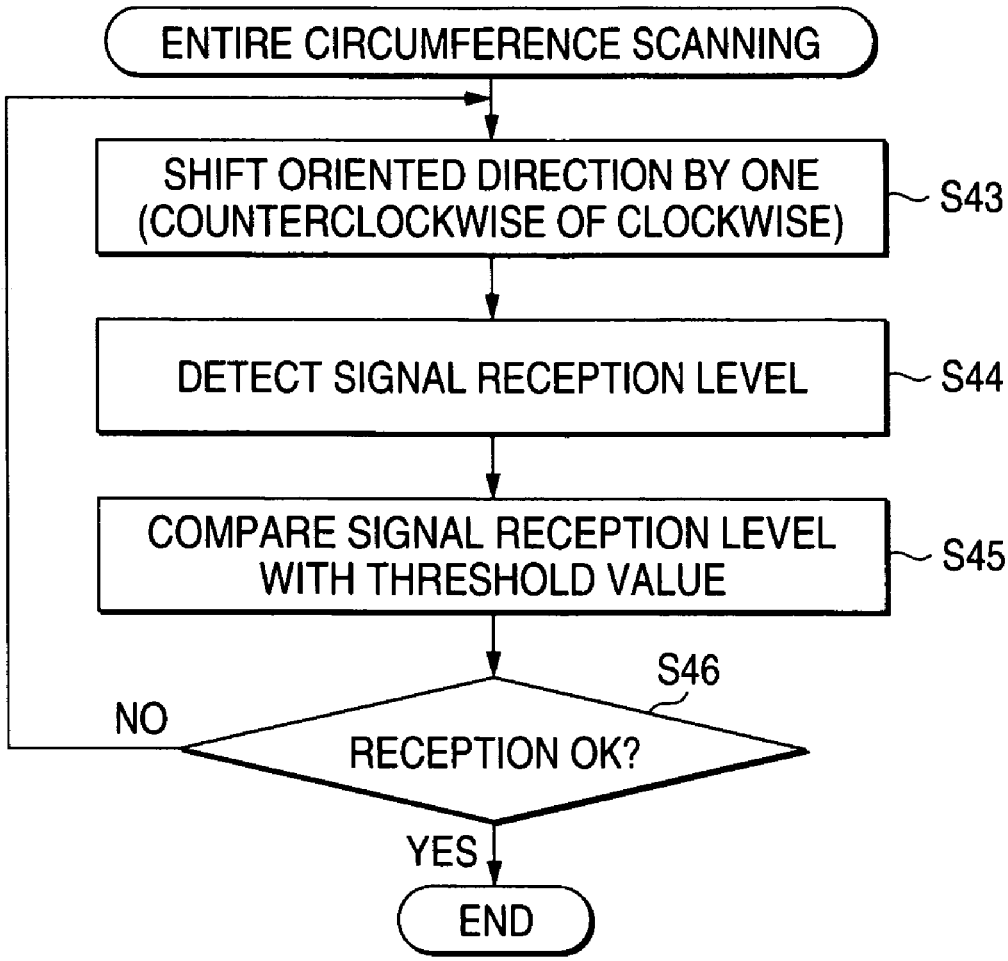
FIG. 9 is a flowchart representing a procedure of the entire circumference scanning.

FIG. 9 is a flowchart representing a concrete procedure of the entire circumference scanning in step S26 of FIG. 3. The CPU of the control unit 4 executes this procedure according to a program stored in the ROM.

When processing of the entire circumference scanning is started, the control unit 4 shifts an oriented direction by one counterclockwise or clockwise (step S43), and detects a level of a received signal in the antenna in its direction (step S44). Then, the level of the received signal detected is compared with a threshold value (step S45) and it is determined whether it is possible or impossible to perform reception (step S46). When the level of the received signal is less than the threshold value, it is determined that it is impossible to perform the reception (step S46: NO), and the flowchart returns to step S43 and the oriented direction is shifted by one and a level of a received signal in the next direction is detected (stepS44). In like manner below, steps S43 to S46 are repeatedly executed until a receivable direction is detected. Then, when the level of the received signal becomes the threshold value or more and it is determined that it is possible to perform the reception (step S46: YES), the processing is ended and the flowchart proceeds to step S28 of FIG. 3.

Next, wait scanning will be described. In the wait scanning, it waits until a certain time has elapsed since a point in time when impossibility of reception occurs and when a return to a normal reception state is not made within the certain time, retrieval of a receivable direction is started. When there is a strong tendency in which an oriented direction is decided in the same direction (direction 0 of FIG. 4, FIG. 8, etc.) as the oriented direction at the time of occurrence of impossibility of reception (step S24 of FIG. 3), there is a high probability capable of reception again in its direction by short waiting even when impossibility of reception occurs. Therefore, in the case of starting scanning in another direction concurrently with the occurrence of impossibility of reception, in reverse, it takes time to detect the receivable direction. Hence, in such a case, the wait scanning for starting the scanning after a lapse of the certain time is most suitable.

Figure 10:
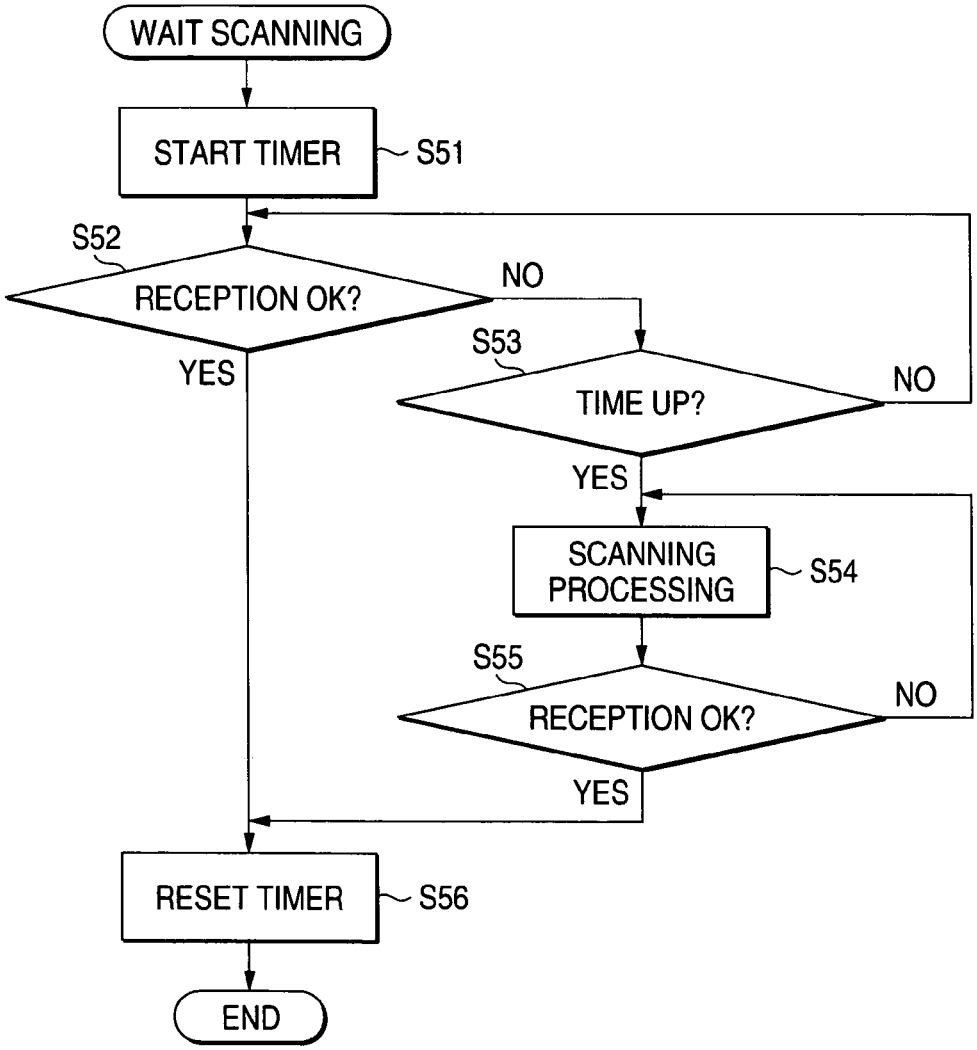
FIG. 10 is a flowchart representing a procedure of wait scanning.

FIG. 10 is a flowchart representing a concrete procedure of the wait scanning in step S27 of FIG. 3. The CPU of the control unit 4 executes this procedure according to a program stored in the ROM.

When processing of the wait scanning is started, a timer starts a timing action (step S51). This timer is disposed in the control unit 4. After the timer starts, with an oriented direction of the antenna maintained in a direction at the time of occurrence of impossibility of reception, the control unit 4 monitors whether or not it is possible to perform reception in its direction (step S52). When it is not possible to perform the reception (step S52: NO), it is determined whether or not time of the timer is up, that is, a certain time has elapsed (step S53) Then, when the time is not up (step S53: NO), the flowchart returns to step S52 and it is monitored whether or not it is possible to perform the reception. When it becomes possible to perform the reception (step S52: YES) by time up of the timer (step S53: NO), the timer is reset (step 556) and the processing is ended and the flowchart proceeds to step S28 of FIG. 3. In this case, it is possible to perform the reception again in the original oriented direction.

On the other hand, when the time of the timer is up (step S53: YES) in a state in which it is not possible to perform the reception (step S52: NO), scanning processing is started at this point in time (step S54). As the scanning at this time, for example, the left and right alternate scanning described above is used. It may be constructed so as to be switched to the entire circumference scanning when a receivable state is not detected even in the case of performing the left and right alternate scanning for a certain time. The control unit 4 determines whether or not it becomes possible to perform reception after the scanning processing is started (step S55), and when it does not become possible to perform the reception (step S55: NO), the flowchart returns to step S54 and the scanning processing is continued. Also, when it becomes possible to perform the reception (step S55: YES), the timer is reset (step S56) and the processing is ended and the flowchart proceeds to step S28 of FIG. 3.

In the embodiments described above, the case of selecting the optimum signal return processing from among the plural signal return processing based on the oriented direction decision information has been taken as an example, but it may be constructed so as to select signal return processing based on reception sensitivity information instead of the oriented direction decision information. In this case, a reception sensitivity table as shown in FIG. 12 is disposed in the memory 8. Reception sensitivity every channel is recorded in this reception sensitivity table. As the reception sensitivity, for example, an average value of the reception sensitivity for the last certain period is used. There is a high possibility capable of reception again in the present oriented direction as the reception sensitivity is higher at the time of impossibility of reception, so that, for example, when the reception sensitivity is 90% or higher, the wait scanning is selected and when the reception sensitivity is 70% or higher and lower than 90%, the left and right alternate scanning is selected and when the reception sensitivity is lower than 70%, the entire circumference scanning is selected. By being constructed in this manner, the return processing with high accuracy according to the reception sensitivity can be performed.

Also, it may be constructed so as to select signal return processing based on time zone in formation instead of the oriented direction decision information. For example, in the U.S.A. etc., there is a time zone with no broadcast in the daytime and radio waves coming in an antenna are sparse as compared with the nighttime. Therefore, in such a case, a receivable direction can be detected speedily by using the entire circumference scanning capable of evenly retrieving each of the directions. On the other hand, in a time zone of the nighttime in which radio waves coming in the antenna are large as compared with the daytime, more efficient retrieval can be performed by using the left and right alternate scanning.

In the embodiments described above, the case of applying the invention to the broadcast receiver 1 to which the smart antenna 2 is connected has been taken as an example, but in addition to the smart antenna, the invention can be applied to a broadcast receiver to which an antenna capable of switching directivity in plural directions, for example, an adaptive array antenna is connected. Also, the invention can be applied to, for example, a broadcast receiver for receiving radio broadcasting or a broadcast receiver for receiving satellite broadcasting.

What is claimed is:

1. A broadcast receiver comprising:

a smart antenna;

a tuner for extracting a signal of a predetermined channel from airwaves received by a smart antenna;

a signal processing unit for processing the signal extracted by the tuner;

a control unit for performing signal return processing for making a return to a normal reception state when it becomes impossible to receive the airwaves by the smart antenna; and a storage unit for storing past oriented direction decision information for every channel, wherein the signal return processing includes:

first signal return processing for retrieving a receivable direction by shifting an oriented direction by a predetermined amount counterclockwise or clockwise from a reference direction using an oriented direction at the time of impossibility of reception as the reference direction and alternately repeating counterclockwise shifts and clockwise shifts while increasing the shift amount;

second signal return processing for retrieving a receivable direction while sequentially shifting an oriented direction over all bearings of the antenna; and third signal return processing for waiting until a certain time has elapsed since a point in time of occurrence of impossibility of reception and starting retrieval of a receivable direction when a return to a normal reception state is not made within the certain time, and when impossibility of reception occurs, the control unit:

reads the past oriented direction decision information corresponding to a channel at that time out of the storage unit, executes the first signal return processing upon determining that there are many cases where an oriented direction decided for the channel is a direction near an oriented direction at the time of the occurrence of impossibility of reception, executes the second signal return processing upon determining that there are many cases where the oriented direction is a direction distant from an oriented direction at the time of the occurrence of impossibility of reception, and executes the third signal return processing upon determining that there are many cases where the oriented direction is the same direction as an oriented direction at the time of the occurrence of impossibility of reception.

2. A broadcast receiver for receiving airwaves by a directional switching antenna capable of switching directivity in a plurality of directions, the broadcast receiver comprising:

a control unit for performing signal return processing for making a return to a normal reception state when it becomes impossible to receive the airwaves by the antenna, wherein the signal return processing includes a plurality of signal return processings of different kinds, and when impossibility of reception occurs, the control unit automatically selects optimum signal return processing from among the plurality of signal return processings according to predetermined conditions and executes the selected signal return processing, wherein the plurality of signal return processings includes:

first signal return processing for retrieving a receivable direction by shifting an oriented direction by a predetermined amount counterclockwise or clockwise from a reference direction using an oriented direction at the time of impossibility of reception as the reference direction and alternately repeating counterclockwise shifts and clockwise shifts while increasing the shift amount;

second signal return processing for retrieving a receivable direction while sequentially shifting an oriented direction over all bearings of the antenna; and third signal return processing for waiting until a certain time has elapsed since a point in time of occurrence of impossibility of reception and starting retrieval of a receivable direction when a return to a normal reception state is not made within the certain time.

3. The broadcast receiver as claimed in claim 2, further comprising:

a storage unit for storing past oriented direction decision information for every channel, wherein when impossibility of reception occurs, the control unit reads the past oriented direction decision information corresponding to a channel at that time out of the storage unit and selects optimum signal return processing from among a plurality of signal return processings based on the information.

4. The broadcast receiver as claimed in claim 3, wherein the control unit selects the optimum signal return processing based on a distance relation, obtained from the oriented direction decision information, between an oriented direction at the time of occurrence of impossibility of reception and an oriented direction determined to be capable of reception at a time of channel selection or signal return processing.

5. The broadcast receiver as claimed in claim 2, further comprising:

a storage unit for storing reception sensitivity of airwaves for every channel, wherein when impossibility of reception occurs, the control unit reads the reception sensitivity corresponding to a channel at that time out of the storage unit and selects optimum signal return processing from among a plurality of signal return processings based on the reception sensitivity.

6. The broadcast receiver as claimed in claim 2, wherein when impossibility of reception occurs, the control unit selects optimum signal return processing from among a plurality of signal return processings based on a time zone at that time.

7. The broadcast receiver as claimed in claim 2, wherein the control unit selects the optimum signal return processing and executes the selected signal return processing when a level of the airwaves received by the antenna becomes less than a predetermined threshold value while a tuner extracts a signal of a predetermined channel from airwaves and a signal processing unit processes the extracted signal.

* * * * *